United States Patent [19]

Schuck

[11] 4,145,147

[45] Mar. 20, 1979

[54] DISPENSING ORAL HYGIENE APPARATUS WITH VENTED MATERIAL CHAMBER

[76] Inventor: Joseph T. Schuck, 11735 Corry Pl., Philadelphia, Pa. 19154

[21] Appl. No.: 808,059

[22] Filed: Jun. 20, 1977

[51] Int. Cl.[2] ..... A46B 11/02

[52] U.S. Cl. ..... 401/175

[58] Field of Search ..... 401/175, 286, 287, 68, 401/132, 135; 222/390, 387; 15/167 A, 104.94; 132/84 R

[56] References Cited

U.S. PATENT DOCUMENTS

| | | | |
|---|---|---|---|
| 1,540,090 | 6/1925 | Shapiro | 401/175 |
| 1,904,612 | 4/1933 | Bramson | 401/175 |
| 2,244,952 | 6/1941 | Kapelman | 222/387 |
| 2,377,837 | 6/1945 | Zimmermann | 401/132 X |
| 2,908,925 | 10/1959 | Reitknecht | 401/175 |
| 2,917,765 | 12/1959 | Jakubowski | 401/175 |

*Primary Examiner*—Ronald E. Suter

*Attorney, Agent, or Firm*—Paul & Paul

[57] ABSTRACT

A toothbrush or gum massage appliance carries its own storage font for toothpaste or similar hygienic materials. The handle portion defines a cavity for such storage, and includes a screw and piston therein for forcing the material from the cavity through a channel and into the brush or massage head. Refilling of the cavity is promoted by a system of slots and ports, whereby air is forced out as toothpaste or the like is introduced at the other end of the cavity.

2 Claims, 5 Drawing Figures

DISPENSING ORAL HYGIENE APPARATUS WITH VENTED MATERIAL CHAMBER

BACKGROUND OF THE INVENTION

This invention relates to oral hygiene products, and more particularly to oral hygiene appliances such as toothbrushes which have self-contained storage font for toothpaste or the like.

The prior art shows many examples of toothbrushes and the like which carry their own accommodation for toothpaste. In accordance with these systems, one example of which is exemplified in U.S. Pat. No. 2,699,889 to G. W. Johnson, the toothbrush handle defines a storage chamber, and a screw and piston therein forces the toothpaste through a channel in the brush, delivering it to the bristles of the brush. Other examples of similar apparatus are shown in U.S. Pat. Nos. 995,626 to Moran, 3,039,476 to Reitknecht, 1,902,859 to Joseph, and 3,728,035 to Reitknecht, and French Pat. Nos. 1,028,367 to Glaser-Schachner, 1,034,682 to Girardin, and 1,011,277 to Thiery.

In the art of self-dispensing toothbrushes and the like, there has occurred a prevailing problem of efficiency in reloading the storage chamber. That is, quite often air pockets form within the chamber, which tend to resist further filling unless appropriate venting is provided. In U.S. Pat. No. 2,774,981 to Solis Bonilla, a vent hole is provided in the side of the brush handle, and in U.S. Pat. No. 1,590,547 to Prusso, which shows a magazine shaving brush, a vented opening is provided at the bottom of the cylinder.

It is an object of the present invention to provide a storage type oral hygiene appliance of the screw and piston variety which provides venting schemes whereby refilling may be accomplished speedily and efficiently, and without the need for sealing adapters between the toothpaste tube and the brush storage receptacle.

It is a further object to provide oral hygiene apparatus of the self-supplying variety which is adaptable to gum message and the like, as well as the basic toothbrushing operation.

SUMMARY OF THE INVENTION

The present invention involves self-supplying toothbrushes of the piston and screw pedigree, wherein venting of the storage chamber is efficiently conducted by means of ports and slots in the motive screw, and at the port of entry of that screw into the storage chamber. Hence, when the piston is positioned for refilling, the storage cavity communicates via a slot in the screw directly through the piston, and via the screw entry port, out to the atmosphere. The slot in the screw extends only slightly beyond the thickness of the piston, whereby it is blocked by the piston substantially upon initiation of the process of advancing toothpaste out into the brush head.

In an illustrative embodiment, a lower handle portion defines a cylindrical cavity therein, penetrated longitudinally by a screw which engages a piston. A piston is thereby slidably but nonrotatably movable through the cavity, in order to force stored toothpaste therefrom. A brush head communicates with the segment, whereby toothpaste is delivered into the bristle portion of the brush. At the end of the storage cavity opposite the brush end, the screw means is slotted and the cavity communicates directly with the atmosphere. Hence, when the piston is positioned for refilling, a cavity vent facilitates introduction of the toothpaste material.

DETAILED DESCRIPTION

Figure 1:
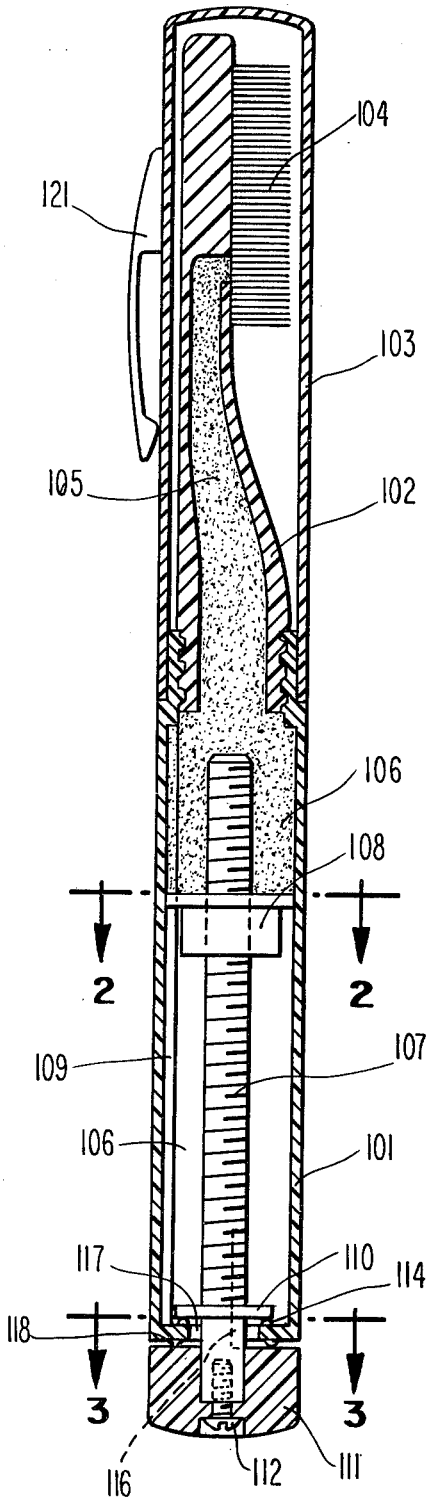
FIG. 1 shows a cross-sectional profile of an illustrative embodiment of the present invention.
Figure 2:
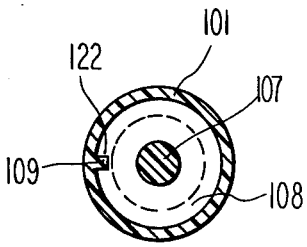
FIGS. 2 and 3 show cross-sectional views of the FIG. 1 embodiment.
Figure 3:
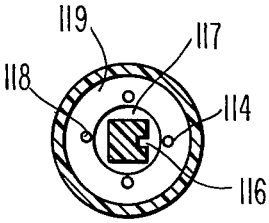

Referring first to FIGS. 1, 2, and 3, there is shown an illustrative embodiment of the present invention. A cylindrical housing 101 generally defines a toothbrush handle, and an upper portion 102, screw matable with the lower portion 101, defines the upper brush portion. An elongated, generally cylindrical cavity 106 within housing 101 communicates with a channel 105 in the upper portion 102, such that toothpaste or the like materials stored in cavity 106 may be forced through the channel 105 and introduced into the bristle portion 104 of the brush. An outer casing 103 fits tightly against the bottom portion 101, and not only hygienically protects the bristle portion 104, but also prevents air drying of the toothpaste material at the point of its introduction into the bristles from the channel 105. A clip 121 allows for pocket engagement and handy carrying.

The embodiment of FIGS. 1 through 3 generally involves the class of devices, exemplified in various prior art references referenced hereinbefore, wherein a screw and piston is utilized to force the toothpaste from the cavity 106 to the bristle portion 104. In FIG. 1, a piston 108 threadedly engages a screw 107. A track 109 extends longitudinally along the cylindrical cavity 106, and the piston 108 defines a slot 122 matable with the track 109; hence, rotational movement of screw 107 facilitates only translational movement of piston 108 within cylinder 106.

The lowermost wall 119 of the housing 101 defines a port 117 whereby the screw member 107 connects to a kurled knob 111. In particular, a screw 112 penetrates knob 111 and fastens it to the lower, unthreaded end of the screw member 107. A flange 110 is carried by the screw member 107 within the cavity 106. A plurality of spacers such as 114, and 118 maintain the knob 111 and flange 110 in predetermined spaced relation to the lower wall 119 of housing 101, and to each other, whereby air communicates from the ambient atmosphere into the channel 106.

Figure 4:
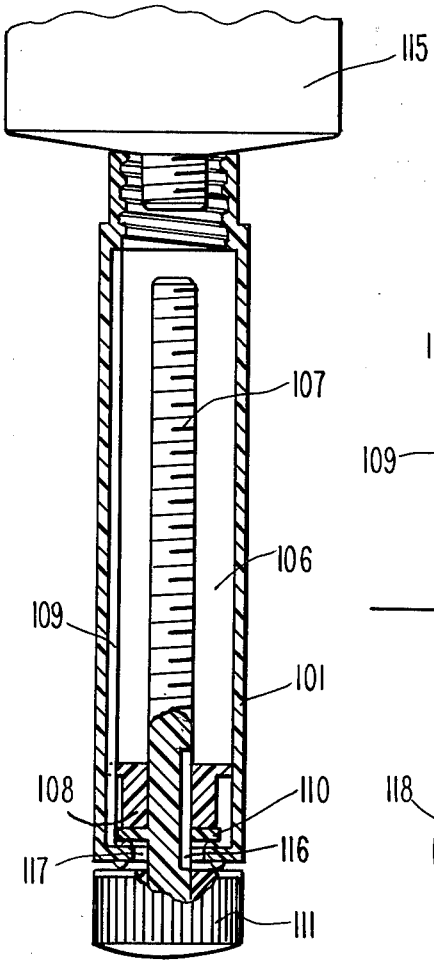
FIG. 4 shows a portion of the FIG. 1 apparatus, positioned for introduction of toothpaste material into the storage cavity.

As set forth hereinbefore, one of the primary features of the present invention relates to its venting facility, and its consequent ease of refilling. This operation will be more clearly understood upon consideration of FIGS. 3 and 4. In particular, FIG. 3 shows the lower cross-section of the FIG. 1 embodiment, and FIG. 4 shows a profile view of that embodiment in condition for refilling. In FIG. 4, the piston 108 is withdrawn to its lowermost point of travel within cavity 106, and a toothpaste tube 115 is positioned for introduction of toothpaste into the cavity 106. Whenever piston 108 is in such lowermost position of travel, a slot 116 in screw member 107 extends from the region of port 117, through the piston 108, and opening into cavity 106. Hence, as toothpaste is introduced into cavity 106, air is driven through the piston 108 via slot 116, and to the ambient atmosphere via the slot 116, port 117, and the space between knob 111 and the lower wall 119 of the housing 101. When the brush portion 102 is re-installed as shown in FIG. 1, and the piston is advanced incrementally to force the toothpaste out into the bristle portion 104, the piston 108 blocks the slot 116, and thereby prevents leakage of toothpaste and occlusion of slot 116.

In a preferred embodiment, it is contemplated that the handle portion 101 be composed of a transparent plastic material, such that during the filling process, toothpaste may be introduced all the way to the proximity of the piston 108 in its position shown in FIG. 4, but not to the extent of introduction and occlusion of the slot 116.

Figure 5:
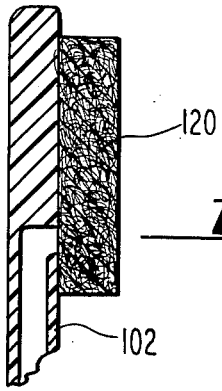
FIG. 5 shows an alternative embodiment, adapted for gum message techniques.

FIG. 5 shows an alternative embodiment, wherein a sponge material 120 is provided at the head 102 in substitution for the bristles 104. It is contemplated that the embodiment of FIG. 5 will be useful for massaging of the gums and the like. For such applications, the cavity 106 may be provided with mouthwash, medicinal, or the like materials in suitable paste or gel form.

It will be understood that the foregoing sets forth preferred and illustrative embodiments of the present invention, but that numerous alternative embodiments will occur to those of ordinary skill in the art without departure from the spirit or the scope of the present invention.

I claim:

1. An oral hygiene appliance comprising:

a cylindrical handle segment defining a cylindrical cavity therein, said handle terminating at one end in a threaded opening into said cavity, said handle having a port into said cavity at the opposite end thereof;

an application member, matably mountable to said threaded opening, said application member having a channel communicating with said cavity;

a piston, slidably and nonrotatably carried in said cavity, said piston engaging the side walls of said cavity;

an elongated screw; extending through said port and into said cavity, threadedly engaging said piston, and extending substantially through said cavity, said screw having a portion thereof extending outwardly from said port beyond said handle segment and being rotatable for translating said piston within said cavity;

a knob connected to said portion of said screw which extends outwardly from said port;

a flange connected to a portion of said screw within said cavity at said port end thereof;

means for spacing said flange away from said port end of said cavity;

means for spacing said knob away from said handle segment; and a slot extending longitudinally along said screw from a point outwardly from the port end of said handle segment to a point within said cavity beyond the position of said flange and beyond said piston when said piston has been translated within said cavity to abut said flange.

2. An appliance as described in claim 1 wherein said application member includes sponge material in association with said channel.

* * * * *

UNITED STATES PATENT OFFICE

CERTIFICATE OF CORRECTION

Patent No. 4,145,147 Dated March 20, 1979

Inventor(s) Joseph T. Schuck

It is certified that error appears in the above-identified patent and that said Letters Patent are hereby corrected as shown below:

Column 1, line 42 "message" should be --massage--

Column 1, line 61 "A" should be --The--

Column 2, line 14 "message" should be --massage--

Column 2, line 45 "kurled" should be --knurled--

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*